United States Patent [19]

Tatterson et al.

[11] 4,298,459

[45] Nov. 3, 1981

[54] FLUID CATALYTIC CRACKING OF HEAVY PETROLEUM FRACTIONS

[75] Inventors: David F. Tatterson; William D. Ford, both of Downers Grove, Ill.

[73] Assignee: Standard Oil Company (Indiana), Chicago, Ill.

[21] Appl. No.: 91,455

[22] Filed: Nov. 5, 1979

[51] Int. Cl.[3] ..... C10G 11/05; C10G 11/18

[52] U.S. Cl. ..... 208/120; 208/113; 252/411 R; 252/417

[58] Field of Search ..... 208/113, 120; 252/411 R, 417

[56] References Cited

U.S. PATENT DOCUMENTS

| | | | |
|---|---|---|---|
| 2,575,258 | 11/1951 | Cornell et al. | 252/417 |
| 3,120,484 | 2/1964 | Mills et al. | 208/150 X |
| 3,408,286 | 10/1968 | Hepp | 208/120 |
| 3,412,013 | 11/1968 | Bowles | 208/120 |
| 3,424,672 | 1/1969 | Mitchell | 208/164 |
| 4,013,546 | 3/1977 | Suggitt et al. | 252/415 |
| 4,176,083 | 11/1979 | McGovern et al. | 208/150 X |
| 4,176,084 | 11/1979 | Luckenbach | 208/113 X |
| 4,200,520 | 4/1980 | Gladrow et al. | 208/120 |

OTHER PUBLICATIONS

Cimbalo et al., "Deposited Metals Poison FCC Catalyst Oil Gas Journal, May 15, 1972, pp. 112–122.

*Primary Examiner*—Delbert E. Gantz

*Assistant Examiner*—G. E. Schmitkons

*Attorney, Agent, or Firm*—William C. Clarke; William T. McClain; William H. Magidson

[57] ABSTRACT

A process for (i) fluid catalytic cracking in a cracking zone of residuum and other heavy oils comprising gas oil, petroleum residue, reduced and whole crudes, and shale oils with high metals content, (ii) wherein the coke deposits on the used cracking catalyst are reduced in amount by regeneration and wherein (iii) contaminant metals comprising nickel, vanadium, copper and iron deposited on the used cracking catalyst are deactivated in sufficient amount to reduce hydrogen and coke formation during the cracking process whereby the said catalyst is suitable for re-use wherein (A) the catalyst particles are contacted with fresh feed and associated recycle feed, and wherein (B) the feed is cracked in a cracking zone, wherein (C) the used catalyst particles are subjected to alternate exposures of up to 30 minutes in duration of conditions comprising (a) an oxidizing zone at a temperature of above 900° F. wherein molecular oxygen in flue gas emitted from the oxidizing zone is over 0.1 volume percent, and (b) a reducing zone at a temperature within the range of from about 900° F. to about 1450° F., wherein the reducing atmosphere is a material selected from the group consisting of hydrogen, hydrocarbons, carbon monoxide, and mixtures thereof and is present in a concentration of from about 4 to 100 volume percent, and wherein (D) the regenerated catalyst can be returned to the cracking zone.

16 Claims, 1 Drawing Figure

FLUID CATALYTIC CRACKING OF HEAVY PETROLEUM FRACTIONS

BACKGROUND OF THE INVENTION

The present invention concerns a fluid catalytic cracking process wherein (a) residuum and other heavy oils are cracked to produce useful products, (b) coke deposits on the used catalyst are reduced in amount by regeneration, and (c) metallo-organic compounds of contaminant metals on the used catalyst are deactivated, wherein the regenerated catalyst is suitable for re-use.

The catalytic cracking of various heavier mineral hydrocarbons, for instance, petroleum or other mineral oil distillates such as straight run and cracked gas oils; petroleum residues, etc., has been practiced for many years. As is well known, "gas oil" is a broad, general term that covers a variety of stocks. The term includes light gas oil (boiling range 400° to 600° F.), heavy gas oil (boiling range 600° to 800° F.) and vacuum gas oils (boiling range 800° to about 1100° F.). The petroleum residues have a boiling range from about 1100° F. and up. The vacuum gas oils and residuals together represent atmospheric reduced crude.

A residual stock is in general any petroleum fraction with a higher boiling range than gas oils. Any fraction, regardless of its initial boiling point, which includes the heavy bottoms, such as tars, asphalts, or other undistilled materials can be termed a residual fraction. Accordingly, a residual stock can be the portion of the crude remaining undistilled at about 1050°-1200° F., or it can be made up of a vacuum gas oil fraction plus the portion undistilled at about 1050°-1200° F. For instance, a topped crude may be the entire portion of the crude remaining after the light ends (the portion boiling up to about 400° F.,) have been removed by distillation. Therefore, such a fraction includes the entire gas oil fraction (400° F. to 1050°-1200° F.) and the undistilled portion of the crude petroleum boiling above 1050°-1200° F.

The behavior of a hydrocarbon feedstock in the cracking reactions depends upon various factors including its boiling point, carbon-forming tendencies, content of catalyst contaminating metals, etc. and these characteristics can affect the operation to an extent which makes a given feedstock uneconomical to employ. Although the cracking catalyst employed can be discarded to prevent a accumulation of poisoning metals in the cracking system, this type of operation represents a substantial cost factor and is economically not feasible. Improvements in the regeneration of catalysts become even more important as the cost of the catalyst rises and thus the effects of low feedstock quality are more burdensome.

Metallic contaminants are found as innate constituents in practically all crude oils. Upon fractionation of the crudes, the metallic contaminants are concentrated in the residua which normally have initial boiling points of about 1000° F. Such residua are conventionally used as heavy fuels, and it has been found that the metal contaminants therein adversely affect the combustion equipment in which the residua are burned. The contaminants not only form ash, which leads to sludging and the formation of deposits upon boiler tubes, combustion chamber walls, the gas turbine blades, but also attack the refractories which are used to line boilers and combustion chambers and severely corrode boiler tubes and other metallic surfaces with which they come into contact at high temperatures.

Efforts of petroleum refiners to employ heavier fractions of crude oil for catalytic cracking have been handicapped due to the heavy coke laydowns experienced in cracking such feedstocks. Coke build-up in catalytic cracking is caused by a number of factors. The presence of high-boiling aromatics and other hydrocarbon coke-formers in the feed contribute to excess coke formation. In high boiling feedstocks these problems are severe since these fractions contain higher proportions than conventional gas-oil feedstocks of coke formers and metal contaminants, which diminish the selectivity of the catalyst. The higher boiling fractions of many crude oils contain substantial portions of metal contaminants, particularly nickel and vanadium components. These metals deposit on the catalyst during the conversion processes so that regeneration of the catalyst to remove coke does not remove these contaminants. This catalyst poisoning modifies the selectivity of a cracking catalyst, causing the catalyst to convert part of the hydrocarbons in the feed to hydrogen and coke rather than the desired light hydrocarbon product. In some commercial operations coke production frequently becomes so severe, due to catalyst poisoning, as well as coke-formers in the feed, that the feed rate or conversion must be reduced to maintain operations with the unit limitations. It is to be understood, therefore, that the problems of catalyst contamination and coke formation prevent full exploitation of heavy feeds.

Contaminant metals in crudes occur naturally. Although traces of most metals have been found in crude oil, the most abundant heavy metals are vanadium, nickel, iron and copper. These metals are catalysts themselves and catalyze dehydrogenation of hydrocarbons and aromatic condensations. Any metal poisons in a fluid catalytic cracker feed, even very small concentrations, will deposit almost quantitatively on the cracking catalyst. These deposits can accumulate to very high levels, eventually causing lowered catalyst performance and higher coke and gas make.

A higher level of metals in feeds is a natural result of processing the heavier, more asphaltenic crudes. For instance, the bulk of metals originally present in a crude will eventually become concentrated in residua such as vacuum-tower bottoms. However, gross metals content cannot be used as a measure of contamination since not all deposited metals are equally effective in producing coke and hydrogen. On a weight basis, nickel and copper are the strongest dehydrogenation catalysts, nickel and copper being about four times as strong as vanadium and about six times as strong as iron. (H. R. Grane, et al., Petrol. Refiner, 40, 5, 170) Copper, however, is typically in very low concentration in feedstocks. Iron which is picked up in vessels and lines due to corrosion and erosion is commonly considered as scale or "tramp" metal and is not considered usually as a significant catalyst contaminant.

It is well-known that freshly deposited metals are more active as poisons than "older" metals that have been subjected to numerous cycles in the regenerator-reactor circuit. Upon exposure to such repeated cycles of oxidation/reduction, the poisoning effects of metals contaminants are slowly diminished, but there are some claims that those metals on zeolite catalysts lose their effectiveness more slowly than those on amorphous catalysts (Oil Gas J. 70, (20), 112 (1972)).

In the residual oil cracking process, the catalyst material is typically withdrawn continuously from the cracking unit and sent to a regenerator where the coke is burned off. High coke yields from cracking residual oils requires removal of a large quantity of excess energy as heat from the regenerator. The contaminant metals remain on the catalyst and continue to catalyze coking-dehydrogenation reactions unless deactivation or removal of these metals takes place. Moreover, although catalytic cracking of residual oils can be more attractive than other processes for utilizing the residual oils, an extremely large economic investment can be required because of the necessity of auxiliary means of removing the excess heat generated by the combustion of the coke in excess of the reactor requirements. Other problems occur relative to steam production in planning a refinery and in utility demands after start-up of a refinery.

In the prior art, it is well-known that the yield of gasoline in the catalytic cracking process decreases with an increase in the coke factor of a catalyst. Duffy and Hart, Chem. Eng. Progr. 48, 344 (1952) reported that yields of gasoline, based on feed disappearance, dropped when the laboratory-measured coke factor of a catalyst rose from 1.0 to 3.0 in commercial cracking of a feedstock containing highly contaminated stocks. This decreased gasoline yield was matched by an equal increase in gas and coke, the metal contaminants being nickel and vanadium. It has also been theorized that metal contaminants, such as iron, nickel, vanadium and copper markedly alter the character of the cracking reactions. Connor, et al., I. & E.C., 49, No. 2, 281 (1957) teach that the aforesaid metals, when deposited upon the surface of cracking catalysts superimpose their dehydrogenation activity in the cracking reactions and convert into carbonaceous residue and gas some of the material that would ordinarily go into gasoline. Conner indicates an additional explanation to explain the variables affecting the carbon-producing factors of a contaminated catalyst, namely, that the degree of dispersion of the metal over the surface of the catalyst, the higher the carbon-producing factor. Connor indicates these factors are approximately inversely proportional to initial surface area and that the carbon producing factor increases with the proportion of catalyst surface area covered by the contaminant. However, as noted above, in the case of iron particularly, some of the "tramp" metal originating from corrosion and other foreign sources is relatively inert as a contaminant and does not promote dehydrogenation or affect selectivity (H. R. Grane, et al, Petrol. Ref. 40, No. 5 (1961) 170). The detrimental effect of so-called "tramp metals" and other metals in dissolved or suspended form in the feedstock or originating in corrosion of equipment can be suppressed by exposure to a reducing gas on a silica-alumina catalyst. (U.S. Pat. No. 2,575,258). When these metals other than tramp metals exist in organic forms and in low concentrations, their removal can be extremely difficult without adverse effects on other desirable catalyst properties (Oil & Gas. J., p. 75, Dec. 11, 1961). Grane reported, op. cit, that when catalysts containing these metals are exposed to the alternating oxidizing and reducing cycles of the regenerator and of the reactor, the activity of the metal contaminants in coke formation decreased but that an increase in oxygen from 4 to 21 percent or length or temperature of the regeneration cycle had little effect. A repeat program carried out at 1050° F. instead of 900° F. gave almost the same results.

Foster, U.S. Pat. No. 3,122,511, teaches demetallization of a silica-alumina cracking catalyst where the hydrocarbon feed is highly contaminated with nickel, iron and/or vanadium by treating the catalyst with a sulfiding vapor, chlorinating the catalyst, followed by washing with an aqueous medium. Connor, et al., U.S. Pat. No. 3,123,548, teaches removal of metallic impurities from silica-alumina cracking catalyst with use of hydrogen sulfide gas at an elevated temperature, then with molecular oxygen and a suspension of a cation exchange resin in an aqueous medium. Similarly, methods are taught in U.S. Pat. Nos. 3,539,290 (elevated oxidizing temperature and fluid wash); 3,073,675 (an ion-exchange process); 3,162,595 (solvent extraction); French Pat. No. 1,363,355 (an ion-exchange process) (CA, 62, 7563c); Belgian Pat. No. 626,409 (an ion-exchange process) (CA, 60, 9080d); U.S. Pat. No. 3,293,192 (regeneration of zeolite catalysts with steam and/or temperatures of 1300°-1700° F.); U.S. Pat. No. 3,008,896 (regenerating used catalysts from residual oils by a stripping gas or medium); U.S. Pat. No. 3,041,270 (an ion-exchange process).

The primary object of this invention accordingly is to provide a fluid cracking process for proper utilization of cracking catalysts used in processing heavy oils such as residual oil, reduced and whole crudes, gas oil, shale oil, etc. wherein heavy metals deposited on the catalyst are rapidly deactivated concurrently with the reduction of coke deposits on the used catalyst during the fluid catalytic cracking process.

Another object of this invention is to provide a process for the catalytic cracking of heavy, asphaltenic crudes containing high levels of heavy metals. Another object is to reduce the coke factor of the cracking catalyst and thus increase yields of gasoline from the cracking stock.

These and other objects and advantages of the present invention will become clear from the following specification. These objects are being attained using the process of the present invention.

SUMMARY OF THE INVENTION

A fluid catalytic cracking process for heavy hydrocarbon feedstocks wherein (a) residuum and other heavy oils are cracked to produce useful products, (b) coke deposits on the used catalyst are reduced in amount by regeneration and (c) contaminant metals on the used catalyst are deactivated, wherein the regenerated catalyst is suitable for re-use.

DETAILED DESCRIPTION OF THE INVENTION

Figure 1:
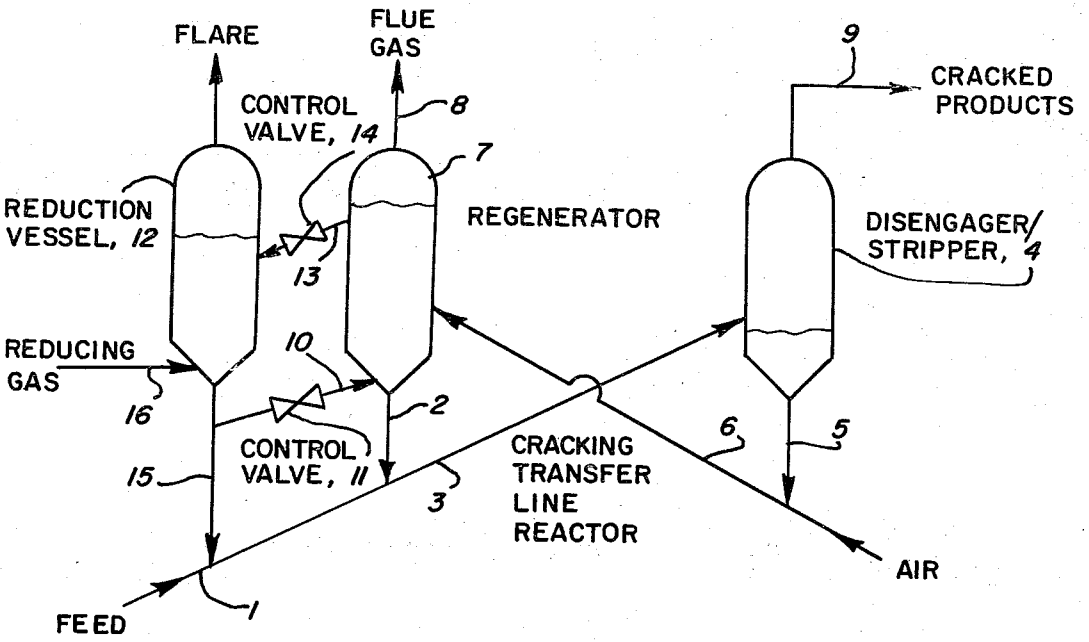

A process for catalytically cracking of residuum and other heavy oils wherein the coke deposits are reduced in amount by oxidation and wherein the contaminant metals are deactivated. The coke oxidation and metals deactivation result from exposure of the used catalyst to a high temperature oxidizing atmosphere in a regenerator vessel followed by exposure to a high temperature reducing atmosphere in a separate reduction vessel. The oxidizing atmosphere can be air, oxygen, steam, the flue gas from a typical fluid catalytic cracking unit regenerator or mixtures thereof. The reducing atmosphere can be produced from any hydrocarbon, hydrogen, carbon monoxide, and mixtures thereof. The heat for the high temperature in the reduction vessel can be supplied from the heat of combustion of the excess coke on the catalyst in the regenerator or from partial combustion of the reduction gas either in or prior to introduction into the reduction vessel. The regenerated catalyst is thereupon recycled to the regenerator vessel or returned to the transfer line cracking reactor to be contacted with fresh feed and associated recycle stream.

An alternative embodiment of this invention comprises the insertion of light hydrocarbons selected from the group consisting of methane, ethane, hydrogen and carbon monoxide into the process of the instant invention in such a manner that the catalyst is maintained in a reducing atmosphere at a temperature within the range of from 900° to 1450° F. prior to contacting the catalyst with fresh feed.

FIG. 1 is a schematic illustration of one embodiment of the invention wherein the residuum feed is catalytically cracked, the coke depositions on the used catalyst are reduced in amount in a regenerator vessel and the metals deactivation is carried out preferentially in a separate metals reduction vessel. The catalyst from the regenerator vessel is transferred to the reduction vessel where a reducing gas is added or produced as needed to maintain the reducing atmosphere. A reducing gas is defined as hydrogen, any hydrocarbon, carbon monoxide and mixtures thereof. A control valve controls the rate of flow of the regenerated catalyst to the metals reduction vessel. A control valve controls the rate of flow of the reduced catalyst from the metals reduction vessel to the transfer line cracking reactor, thus cycling the regenerated catalyst.

The essence of the invention is that a fluid catalytic cracking process for heavy petroleum fractions takes advantage of (1) an oxidizing atmosphere wherein oxygen is present of a concentration in the flue gas of greater than 0.1 volume percent, preferably over 1.0 volume percent, and reduces in amount coke deposits on the used catalyst particles and (2) a reducing atmosphere wherein a reducing gas is present at a concentration of from about 4 to about 100 volume percent, preferably from about 75 to about 100 volume percent, more preferably at about 100 volume percent, at high temperatures and accelerates deactivation of contaminant metals on the used catalyst particles. It has been found that alternate high temperature oxidizing and reducing atmospheres quickly deactivate the contaminant metals. The rate of this deactivation process can be accelerated greatly by increasing the temperature of the catalyst in both the oxidation and reducing atmospheres. Oxidizing temperatures within the range of from about 850° F. to about 1500° F. in the regeneration vessel are an essential requirement of this invention. Reducing temperatures within the range of from about 900° F. to about 1,450° F. are essential, from about 1,200° F. to about 1,450° F. are preferred.

The hydrocarbon feed can be any stock which contains organo contaminant metals and can contain a major or at least a substantial fraction which cannot be vaporized at atmospheric pressure without extensive decomposition. Such stocks can be of virgin nature such as atmospheric residua, vacuum residua, whole crudes, or they may be cycle stocks such as visbreaker tar or clarified oil obtained as bottoms upon fractionation of catalytically cracked gas oil, shale oil, and so on. In general, stocks used as feeds in the present invention will be characterized by a boiling range extending well above 1,000° F. to as much as 1,300° F. However, typically the feed will have a boiling point within the range of from about 650° to 1500° F., a gravity of about −10° to 30° API, and a Conradson carbon content of about 5 to 40 weight percent. Metals content of the feedstock can be as high as 50 parts per million (ppm) of nickel, 100 ppm of vanadium, 50 ppm of copper and 200 ppm of iron. Metals content on the used catalyst can be as high as 10,000 ppm of nickel, 10,000 ppm of vanadium, 10,000 ppm of iron and 5,000 ppm of copper.

Suitable hydrocarbon cracking catalysts for use in the practice of this invention include all high-activity solid catalysts which possess thermal stability under the required conditions. Suitable catalysts include those of the amorphous silica-alumina type having an alumina content of about 10 to about 65 weight percent. Catalysts of the silica-magnesia type are also suitable which have a magnesia content of about 20 weight percent. Preferred catalysts include those of the zeolite-type which comprise from about 0.5 to about 50 weight percent and preferably from about 1 to about 50 weight percent of a crystalline alumino-silicate component distributed throughout a porous matrix. Zeolite type cracking catalysts are preferred because of their thermal stability and high catalytic activity.

The crystalline aluminosilicate or zeolite component of the zeolite-type cracking catalyst can be of any type or combination of types, natural or synthetic, which is known to be useful in catalyzing the cracking of hydrocarbons. Suitable zeolites include both naturally occurring and synthetic aluminosilicate materials such as faujasite, chabazite, mordenite, Zeolite X (U.S. Pat. No. 2,882,244), Zeolite Y (U.S. Pat. No. 3,130,007) and ultrastable large-pore zeolites (U.S. Pat. Nos. 3,293,192 and 3,449,070). The crystalline aluminosilicates have a faujasite-type crystal structure, are particularly suitable and include natural faujasite, Zeolite X and Zeolite Y. These zeolites are usually prepared or occur naturally in the sodium form. The presence of this sodium is undesirable, however, since the sodium zeolites have a low stability under hydrocarbon cracking conditions. Consequently, for use in this invention the sodium content of the zeolite has ordinarily been reduced to the smallest possible value, generally less than about 1.0 weight percent and preferably below about 0.3 weight percent through ion exchange with hydrogen ions, hydrogen-precursors such as ammonium ion, or polyvalent metal cations including calcium, magnesium, strontium, barium and the rare earth metals such as cerium, lanthanum, neodymium and their mixtures. Suitable zeolites are able to maintain their pore structure under the high temperature conditions of catalyst manufacture, hydrocarbon processing and catalyst regeneration. These materials have a uniform pore structure of exceedingly small size, the cross-section diameter of the pores typically being in the range from about 4 to about 20 angstroms. Catalysts having a larger cross-section diameter can also be used.

The matrix of the zeolite-type cracking catalyst is a porous refractory material within which the zeolite component is dispersed. Suitable matrix and materials can be either synthetic or naturally occurring and include, but are not limited to, silica, alumina, magnesia, boria, bauxite, titania, natural and treated clays, kieselguhr, diatomaceous earth, kaolin and mullite. Mixtures of two or more of these materials are also suitable. Particularly suitable matrix materials comprise mixtures of silica and alumina, mixtures of silica with alumina and magnesia, and also mixtures of silica and alumina in combination with natural clays and clay-like materials. Mixtures of silica and alumina are preferred, however, and contain preferably from about 10 to about 65 weight percent of alumina mixed with from about 35 to about 90 weight percent of silica, and more preferably from about 25 to about 65 weight percent of alumina mixed with from about 35 to about 75 weight percent of silica.

The method of this invention can be employed in any conventional fluid catalytic cracking scheme wherein the feedstock is subjected to cracking in a reaction zone in contact with fluidized solid particles comprising cracking catalyst at a temperature from about 850° F. to 1500° F.

The oxygen-containing gas to the regenerator can comprise an oxygen-containing gas selected from the group consisting of molecular oxygen, air, and oxygen in the presence of inert diluents, which can comprise nitrogen, argon, carbon dioxide and similar inert gases.

The regenerator reaction comprising the oxidizing zone is moderated and controlled by the amount of oxygen introduced into the regenerator. The use of air in the oxygen mix results in a regenerator temperature within the range of from about 900° F. to about 2,200° F. The use of molecular oxygen in oxygen-containing mix without an inert diluent will raise the regenerator temperature range to about 1,600° F. and above. The use of molecular oxygen versus the use of air reduces catalyst residence time in the regenerator, removes an increased amount of coke from the coked catalyst, effectively increases the capacity of the regenerator vessel to burn increased quantities of coke from the catalyst. Accordingly, the regenerator reaction rate is moderated and controlled by the oxygen-volume ratio of the oxygen mix. Any suitable amount of molecular oxygen can be used in the oxygen mix from about 0.1 up to about three to four pounds of oxygen (as molecular oxygen) per pound of coke on the coked catalyst or approximately one/half to about 20 pounds of air per pound of coke on the coked catalyst. Corresponding amounts of oxygen and inert diluents such as nitrogen and carbon dioxide when used in place of air are suitable. Excess quantities of oxygen in the form of elemental oxygen, air, and oxygen mixed with inert diluents can be used if required.

In the practice of this invention, the duration of the individual cyclical exposures to the oxidizing atmosphere and to the reducing atmosphere is not entirely temperature-dependent if the temperature is within the required range. Individual cyclical exposure to the oxidizing atmosphere and to the reducing atmosphere can be as short as 0.1 second to as long as 30 minutes per cycle depending upon the temperature. For example, a temperature within the range of approximately 1050°-1200° F. and a cycle residence time of approximately 5 minutes are considered suitable.

The determination of the necessary cycle residence time in the practice of this invention can be determined by means known to those skilled in the petroleum refining arts. Typically, calculations based regenerator and reduction vessels volumes, quantities of catalyst and cracking stock feed, and a material balance will furnish the necessary data for calculating cycle residence times.

In the practice of this invention, the feedstock to the transfer line reactor is preheated to a suitable temperature by means which are not shown in FIG. 1 and then is transported by means of a pump into the bottom part of the lower section of the transferline reactor wherein the feed contacts the catalyst introduced from the regenerator. The catalyst has a temperature of within the range of from about 850° F. to about 1500° F. The ratio of catalyst to oil on a weight basis should be within the range of from about 1:1 to about 30:1. Usually the oil feed contains steam for obtaining good feed dispersion. When the dispersion contacts the catalyst, a portion of the oil feed is vaporized and this plus the dispersion steam serves to circulate the catalyst.

Gas-liquid cracking products and the coked catalyst from the reactor are passed into a disengager/stripper and thence into separate vessels. The gas-liquid cracking products and overhead from the disengager/stripper are passed to a fractionator not shown in FIG. 1 for further processing. The coked catalyst is passed into a regenerator, or into a regenerator and then into a reduction vessel.

Referring to FIG. 1, the petroleum hydrocarbon feed is introduced by line 1 to the process and is mixed with catalyst from lines 2 and 15 prior to entering the transfer line reactor 3, the output of transfer line reactor 3 passing to disengager/stripper vessel 4. Bottoms from the disengager/stripper 4 comprising spent coked catalyst are transported by line 5 to line 6 wherein the spent coked catalyst is introduced to the regenerator 7. Overhead from the disengager/stripper 4 is passed to a fractionator by line 9. Flue gases from regenerator 7 are passed to suitable equipment for heat removal and for particulate control (not shown) by line 8.

The temperature in the oxidation atmosphere of regenerator 7 is greater than 900° F., preferably in the range greater than about 1,050° F. and most preferably greater than 1,200° F. Preferably, the carbon on catalyst is reduced from within the range of about 1.0 weight percent to about 5.0 weight percent to about 0.01 weight percent to about 0.5 weight percent. The decoked catalyst then flows down line 2 into the lower section of the transfer line reactor 3. The flue gas from the upper section of the regenerator 7 is passed by line 8 to suitable equipment for heat removal and particulate control. Carbon combustion occurs in regenerator 7, and with combustion of the coke on the catalyst provides heat for the regenerated catalyst going to the transfer line reactor vessel by line 2 and for the reactor feedstock in line 1. Partially decoked catalyst is recycled as bottoms from regenerator vessel 7 by line 13 to the reduction vessel 12.

Referring to FIG. 1, it is preferred that the reduction vessel 12 is maintained at a temperature within the range from about 900° F. to about 1450° F. The reducing atmosphere can result from limited oxidation of any hydrocarbon or of suitable hydrocarbons, hydrocarbon mixture, or the reducing atmosphere can comprise hydrogen or a hydrogen-hydrocarbon mixture. Examples of suitable hydrocarbons are methane, ethane or mixtures in any proportions, a typical gas oil or a residua. Hydrogen and lighter hydrocarbons such as methane and ethane and mixtures thereof are preferred.

Control valve 14 in line 13 controls the rate of flow from the regenerator 7 to the reduction vessel 12. Catalyst is recycled from the reduction vessel 12 to the regenerator 7, if required, by line 10. Flow through line 10 is controlled by some suitable means such as a control valve 11 or by differential pressures. Reduced catalyst from the reduction vessel 12 is transported by line 15 to line 1 where the reduced catalyst contacts fresh feedstock. The reducing gas is introduced by line 16 to the reduction vessel. The temperature in the reduction vessel 12 is greater than 900° F., preferably in the range greater than 1,050° F. and most preferably greater than 1,200° F.

In summary, the invention comprises a fluid catalytic cracking process for heavy hydrocarbon feedstocks such as residual oil wherein residuum and other heavy oils are cracked to produce useful products, coke deposits on the used catalyst are reduced in amount and contaminant metals on the used catalyst are deactivated wherein the contaminant metals are deactivated by (a) an oxidizing atmosphere wherein the oxygen concentration in the flue gas emitted is greater than 0.1 volume percent, preferably over 1.0 volume percent and (b) a reducing atmosphere wherein the reducing gas is present in a concentration of from about 4 to about 100 volume percent, preferably from about 75 to about 100 volume percent, more preferably at about 100 volume percent, the temperature of the oxidizing atmosphere being in the range from about 850° F. to 1500° F. and the temperature of the reducing atmosphere being within the range from about 900° F. to about 1450° F., and wherein the used catalyst is thereupon suitable for re-use in a cracking reactor with a temperature in the range of from about 850° F. to about 1100° F.

The present invention has been illustrated with respect to catalyst derived from catalytic cracking of a residual oil. However, it should be understood that the improved method and means of this invention can be applied generally for hydrocarbon conversion, and that the illustration of the the invention is not intended to limit the scope of the invention.

EXAMPLE I

A sample of a cracking catalyst obtained from a fluid catalytic cracking unit was analyzed and properties determined. After analysis, the catalyst was used in cracking residual oils and thereupon analyzed again. The results as to Sample 378-02 are in the following Table I.

TABLE I

| | Before Resid Cracking | After Resid Cracking |
|---|---|---|
| Support Type | | |
| Cracking Activity, RMA[a] | 110 | 65 |
| Carbon Factor (CF) | 1.4 | 3.85 |
| Surface Area, $m^2/g$ | 75 | 66 |
| Pore Volume, cc/g | 0.26 | 0.27 |
| Metals Analysis (wppm) | | |
| Nickel | 185 | 3600 |
| Vanadium | 135 | 6600 |
| Iron | 3800 | 4400 |
| Alumina Content, Wt. % | 43.3 | 43.3 |
| Sieve Type | RE-Y | RE-Y |
| Medium Pore Radius, Å | 132 | 133 |

Note:
[a]Relative Micro Activity

Carbon factor is defined as relative coke producing activity of the catalyst relative to a standard catalyst at the same gas oil volume percent conversion.

Sample of the metals contaminated catalyst 378-02 was reduced in a hydrogen reducing atmosphere at 1,200° F. for six hours. Sample of the metals contaminated catalyst 378-02 was also exposed to 20 oxidation/reduction cycles of air/hydrogen at 1,200° F. Each cycle consisted of a five minute purge of nitrogen, a five minute oxidation, a five minute purge of nitrogen and a five minute reduction. Catalyst samples were taken at 10 and 20 cycles. The reductions and oxidations were performed in a quartz reactor fitted with means to inject alternately measured quantities of air, nitrogen and hydrogen at the bottom of the reactor. The reactor was inserted into an electric furnace. A thermocouple was inserted in a thermowell in the top of the reactor. The thermocouple was situated in the thermowell such that it was located approximately in the middle of the catalyst bed. An external temperature indicatior and controller indicated and controlled the reactor temperature up to 1,500° F.

The dehydrogenation activity of the metals on Catalyst 378-02 was determined using a micro cracking unit (MCU) to determine carbon factor (CF) and catalyst activity. Prior to all oxidations and reductions, the catalyst was brought to a temperature of 1,200° F. in a nitrogen atmosphere. The results are detailed in Table II.

TABLE II

| 378-02 Catalyst After Hydrogen Regeneration | | |
|---|---|---|
| Treatment | RMA | CF |
| Control | 65 | 3.90 |
| After 6 hrs in Hydrogen at 1,200° F. | 62 | 3.80 |
| After 10 cycles: Air/Hydrogen | 78 | 3.20 |
| After 20 cycles: Air/Hydrogen | 81 | 2.93 |

The above results indicate significant deactivation of contaminant metals occurs with 10 to 20 cycles of oxidation/reduction cycles and that both oxidizing and reducing atmospheres at high temperature are required for rapid deactivation.

No significant deactivation was shown by a 1200° F. reducing temperature alone, thus indicating both oxidizing and reducing cycles are necessary for metals deactivation.

EXAMPLE II

The procedure of Example I was repeated, except that the oxidizing and reducing temperatures were 950° F. and 1,050° F. Measurements were made of the carbon factor (CF) and relative micro cracking activity (RMA). The results are in Table III. The catalyst used was 378-02 with contaminant metals content of 3,600 ppm nickel, 6,600 ppm vanadium and 4,400 ppm iron. The reducing atmosphere comprised a gas oil having a boiling range within 600° F. to 1000° F. and characterized by an average boiling point of approximately 750° F.

TABLE III

| Catalyst Regeneration - Gas Oil Atmosphere | | | | | |
|---|---|---|---|---|---|
| Run No. | No. of Oxidizing | Reducing | | | |
| Sample No. | Reducing Cycles | Temp., °F. | MCU Run No. | RMA | C.F. |
| 5376-02 | | | | | |
| 03 | 14 | 950 | 76-593 | 61 | 4.15 |
| 04 | 42 | " | 76-495 | 53 | 3.78 |
| 05 | 132 | " | 76-497 | 63 | 3.37 |
| 07 | 254 | " | 76-597 | 62 | 3.75 |
| 09 | 393 | " | 76-654 | 60 | 3.78 |
| 5376-04 | | | | | |
| 01 | 39 | " | 77-94 | 61 | 3.49 |
| 05 | 279 | " | 77-61 | 55 | 3.55 |
| 06 | 500 | " | 77-62 | 58 | 3.33 |
| 08 | 1000 | " | 77-83 | 57 | 3.41 |
| 09 | 1512 | " | 77-85 | 65 | 3.11 |
| 10 | 2047 | " | 77-80 | 58 | 3.33 |
| 5377-01 | | | | | |
| 03 | 30 | " | 113D | 57 | 3.98 |
| 07 | 99 | " | 77-161 | 62 | 3.32 |
| 08 | 265 | " | 77-162 | 62 | 3.23 |
| 09 | 504 | " | 77-166 | 52 | 3.07 |
| 10 | 767 | " | 77-167 | 50 | 3.16 |
| 11 | 1006 | " | 77-212 | 45 | 3.35 |

TABLE III-continued

| Run No. / Sample No. | No. of Oxidizing Reducing Cycles | Reducing Temp., °F. | MCU Run No. | RMA | C.F. |
|---|---|---|---|---|---|
| Catalyst Regeneration - Gas Oil Atmosphere | | | | | |
| 5378-02 | | | | | |
| 02 | 115 | 1050 | 111A | 54 | 3.62 |
| 05 | 374 | " | 109B | 57 | 3.48 |
| 07 | 615 | " | 108D | 57 | 3.25 |
| 08 | 880 | " | 107B | 65 | 2.91 |
| 11 | 1230 | " | 114A | 60 | 2.93 |
| Control 378-02 | 0 | — | 76-493 | 63.8 | 3.80 |
| Control 378-02 | 0 | — | 76-494 | 58.8 | 3.92 |

The data in Table III indicate that the rate of metals deactivation increases as the temperature of the reducing atmosphere increases.

EXAMPLE III

Samples of the catalyst of Example I were exposed to cycles of carbon monoxide and air at 1200° F. Each cycle consisted of a 5-minute purge with nitrogen, a 5-minute air oxidation, a 5-minute purge with nitrogen and a 5-minute carbon monoxide reduction. Results are in Table III.

TABLE III

| Treatment | RMA | CF |
|---|---|---|
| 378-02 Catalyst After Carbon Dioxide Regeneration | | |
| Control | 65 | 3.90 |
| 10 Cycles--CO/Air at 1200° F. | 63 | 3.3 |
| 25 Cycles--CO/Air at 1200° F. | 78 | 3.0 |

The above results indicate that carbon monoxide is an effective reducing agent for the deactivation of contaminant metals.

What is claimed is:

1. A process for the fluid catalytic cracking of hydrocarbon feedstocks containing metallo-organic compounds wherein (i) coke deposits on the used cracking catalyst are reduced by regeneration from a range of from about 1.0 weight percent to about 5.0 weight percent to a range from about 0.01 weight percent to about 0.5 weight percent, (ii) metal deposits in the used cracking catalyst are deactivated in sufficient amounts by alternate exposures to oxidizing and reducing zones in cycles of up to 30 minutes in duration to reduce hydrogen and coke formation during said cracking, whereby the said catalyst is suitable for reuse, which process comprises:

(a) cracking said feedstock at a temperature from about 850° F. to about 1500° F. in a reaction zone in contact with fluidized solid particles, the said particles comprising a cracking catalyst;

(b) withdrawing said particles from said reaction zone;

(c) subjecting the said particles to said oxidizing zone wherein molecular oxygen in flue gas emitted from said oxidizing zone is over 0.1 volume percent and temperature is in the range from about 900° F. to about 2200° F;

(d) withdrawing the said particles from said oxidizing zone;

(e) subjecting said particles to said reducing zone wherein a reducing atmosphere is present in a concentration from about 4 to 100 volume percent and temperature is in the range of from about 900° F. to about 1450° F.;

(f) recycling said particles to said oxidizing zone;

(g) withdrawing said particles from said reducing zone or said oxidizing zone wherein said particles are in a condition suitable for reuse in the said reaction zone.

2. The process of claim 1 wherein the said metal compounds of said hydrocarbon feedstocks comprise at least one metal selected from the group consisting of nickel, vanadium, copper and iron in concentrations up to 50 ppm of nickel, 100 ppm of vanadium, 50 ppm of copper and 200 ppm of iron.

3. The process of claim 1 wherein the said metal deposits on said used cracking catalyst are present in concentrations of up to 10,000 ppm of nickel, 10,000 ppm of vanadium, 10,000 ppm of iron and 5,000 ppm of copper, individually and as mixtures thereof.

4. The process of claim 1 wherein said particles comprising a cracking catalyst are selected from the group of cracking catalysts consisting of a amorphous silica-alumina type having an alumina content of about 10 to about 65 weight percent, a silica-magnesia type having a magnesia content of about 20 weight percent and a zeolite-type which comprises from about 0.5 to about 50 weight percent of a crystalline aluminosilicate component distributed throughout a porous matrix.

5. The process of claim 1 wherein the said oxidizing zone is in a regenerator vessel and the said reducing zone is in a metals deactivation vessel.

6. The process of claim 1 wherein the temperature of the said reducing zone is within the range of from about 1,050° F. to 1,450° F.

7. The process of claim 1 wherein the temperature of the said reducing zone is within the range of from about 1,200° F. to 1,450° F.

8. The process of claim 1 wherein the said molecular oxygen in flue gas emitted from said oxidizing zone is over 1.0 volume percent.

9. The process of claim 1 wherein the said oxidizing atmosphere comprises at least one component selected from the group consisting of air, steam, molecular oxygen, a fluid catalytic cracker flue gas and mixtures thereof.

10. The process of claim 1 wherein the said reducing atmosphere comprises at least one component selected from the group consisting of hydrogen, carbon monoxide, any hydrocarbon, a hydrogen-hydrocarbon mixture, and mixtures thereof.

11. The process of claim 1 wherein the said reducing atmosphere comprises hydrogen.

12. The process of claim 1 wherein the concentration of said reducing atmosphere in said reducing zone is from about 75 to about 100 volume percent.

13. The process of claim 1 wherein the concentration of said reducing atmosphere in said reducing zone is at about 100 volume percent.

14. The process of claim 1 wherein the said reducing atmosphere comprises any hydrocarbon.

15. The process of claim 1 wherein the said reducing atmosphere comprises carbon monoxide.

16. The process of claim 1 wherein said hydrocarbon feedstocks comprise at least one component selected from the group consisting of atmospheric residua, vacuum residua, whole crudes, visbreaker tar, bottoms of catalytically cracked gas oil and shale oil.

* * * * *